US007644758B2

(12) United States Patent
Coronado et al.

(10) Patent No.: US 7,644,758 B2
(45) Date of Patent: Jan. 12, 2010

(54) RESTRICTOR VALVE MOUNTING FOR DOWNHOLE SCREENS

(75) Inventors: Martin P. Coronado, Cypress, TX (US); Stephen L. Crow, Kingwood, TX (US); Knut Herman Henriksen, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 276 days.

(21) Appl. No.: 11/740,080

(22) Filed: Apr. 25, 2007

(65) Prior Publication Data

US 2008/0264628 A1 Oct. 30, 2008

(51) Int. Cl.
*E21B 43/08* (2006.01)

(52) U.S. Cl. ..... 166/205; 166/227; 166/229

(58) Field of Classification Search ..... 166/205, 166/227, 229

See application file for complete search history.

(56) References Cited

U.S. PATENT DOCUMENTS

| | | | | |
|---|---|---|---|---|
| 1,177,070 | A * | 3/1916 | Walker | 166/205 |
| 3,319,927 | A * | 5/1967 | Thompson | 251/145 |
| 3,390,724 | A | 7/1968 | Caldwell | |
| 5,127,474 | A * | 7/1992 | Schroeder et al. | 166/278 |
| 5,228,518 | A * | 7/1993 | Wilson et al. | 166/369 |
| 5,355,956 | A * | 10/1994 | Restarick | 166/296 |
| 5,526,881 | A * | 6/1996 | Martin et al. | 166/296 |
| 5,842,516 | A * | 12/1998 | Jones | 166/56 |
| 6,505,682 | B2 | 1/2003 | Brockman | |
| 6,619,397 | B2 * | 9/2003 | Coon et al. | 166/278 |
| 6,745,843 | B2 * | 6/2004 | Johnson et al. | 166/386 |

(Continued)

FOREIGN PATENT DOCUMENTS

| | | |
|---|---|---|
| WO | 9210639 | 6/1992 |

(Continued)

OTHER PUBLICATIONS

Parlar, M., et al., "Guidelines for Selection of Fluid Loss Control Methods Before and After Sand Control Treatments to Maximize Well Productivity and Cost-Effectiveness", SPE 39460, Feb. 1998, 1-16.

(Continued)

*Primary Examiner*—Shane Bomar
(74) *Attorney, Agent, or Firm*—Steve Rosenblatt

(57) ABSTRACT

In one aspect of the invention a valve that operates in association with a downhole screen is threaded into the wall of a base pipe after being inserted through a saddle. When the valve body is threaded in, the engagement into the wall threads in the base pipe acts as a sealing force on a ring seal between the saddle and the base pipe and between the valve body and the saddle. The valve itself can be outfitted with a cover with openings that can be integral or removable and disposed at the end of the valve that is innermost to the base pipe. Preferably a series of elongated slots are used that can catch slurry if the well is to be killed while allowing subsequent production to drive the accumulated solids from well killing back into the base pipe. Another feature places the valve in a base pipe opening under a cylindrical screen section to reduce assembly time and cost of constructing an adjacent housing to one side of the cylindrical screen section to accommodate the valve.

22 Claims, 8 Drawing Sheets

U.S. PATENT DOCUMENTS

| | | | | |
|---|---|---|---|---|
| 6,899,176 | B2 * | 5/2005 | Hailey et al. | 166/278 |
| 6,976,542 | B2 | 12/2005 | Henriksen et al. | |
| 7,059,415 | B2 | 6/2006 | Bosma et al. | |
| 7,240,739 | B2 * | 7/2007 | Schoonderbeek et al. | 166/386 |
| 7,428,924 | B2 * | 9/2008 | Patel | 166/250.01 |
| 2002/0096329 | A1 * | 7/2002 | Coon et al. | 166/278 |
| 2002/0189815 | A1 | 12/2002 | Johnson et al. | |
| 2006/0027377 | A1 | 2/2006 | Schoonderbeek et al. | |

FOREIGN PATENT DOCUMENTS

| | | | |
|---|---|---|---|
| WO | 9626350 | | 8/1996 |
| WO | 03064811 | A2 | 8/2003 |
| WO | 2004097167 | A1 | 11/2004 |

OTHER PUBLICATIONS

Bixenman, P.W., et al., "Design and Deployment of an Intelligent Completion with Sand Control", SPE 71674, Sep. 2001, 1-9.

Innes, Gareth, et al., "Combining Expandable and Intelligent Completions to Deliver a Selective Multizone Sandface Completion, Subsea Nigeria", SPE 108601, Sep. 2007, 1-11.

Worlow, D.W., et al., "Pressure-Actuated Isolation Valves for Fluid Loss Control in Gravel/Frac-Pack Completions", SPE 58778, Feb. 2000, 1-6.

Ross, Colby M., et al., "Current Materials and Devices for Control of Fluid Loss", SPE 54323, Apr. 1999, 1-16.

* cited by examiner

RESTRICTOR VALVE MOUNTING FOR DOWNHOLE SCREENS

FIELD OF THE INVENTION

The field of the invention relates to downhole screens and more particularly to screens with valves in the base pipe and various mounting techniques for such valves.

BACKGROUND OF THE INVENTION

Screens are used downhole to hold back solids during production from a given productive zone. Such zones can be very long and can be in cased or open hole. In the past screen sections, which can be about 10 meters long are connected together to span the productive interval. In an effort to equalize flow along a long interval, individual screen sections have been outfitted with devices to resist flow in unequal amounts so as to insure flow that is reasonably uniform over the extended interval. Such screen sections are made by Baker Oil Tools under the brand Equalizer®. They feature an annular space between the cylindrical screen and an underlying base pipe. Once the flow gets through the screen it goes axially along the base pipe which has no openings under the cylindrical screen section except an axial passage into a housing formed over the base pipe and to one side of the cylindrical screen section. The passage to the housing from under the cylindrical screen can involve a flow restriction, such as a spiral path. Spiral paths in different screen sections can get less restrictive to a given flow rate as the screen sections get further from the surface of the well, or be set to create equal resistance over the entire interval. In that way they equalize flow over a long interval.

More recently, there has been an interest developed in being able to sense whether liquid or gas is being produced into a screen and to provide valving to sense this change with a goal of admitting the liquid flow and cutting off the flow if gas is produced. Several such valves have been developed that can make this distinction and their internal construction is not the focus of the present invention. Rather, with the advent of the designs that can operate in different positions depending on whether liquid or gas flows through them, there have arisen problems that relate to how the components can be assembled for reliable operation, how the overall construction can be optimized for lower assembly cost and how one or a series of such screens can accommodate a need to kill a well and still function reliably thereafter, to name some of the more significant issues.

One issue with these valves is how to mount them in a manner where they don't leak. Threading the wall of the base pipe so that the valve assembly can be screwed in has built in leakage potential that a thread sealant does not fully resolve. The base pipe wall only allows so many thread turns and that has been a cause for concern regarding leakage. Welding the valve into a hole in the base pipe is not a viable option either as the valve components are sensitive to heat created during the welding process so as to make the operation of a welded into position valve somewhat uncertain. Removal of the valve at a later time without destroying it was also an issue. An alternative way to mount these valves so as to minimize or eliminate the risk from thread leaks was developed as part of the present invention.

These valves had narrow tortuous paths through them. One problem with them arose when there was a need to kill the well. Frequently, a well killing technique that was used with screens in the assembly was to pump down slurry into the base pipe to block the narrow slots within the base pipe where the filtered produced liquids would enter the base pipe. The problem with the valves that discriminate between liquid and gas flow was that solids that get to their internal passages would prevent them from operating later when it was time to bring the well in again after killing it. The manner that these valves were mounted left their internal components exposed to slurry used to kill the well from within the base pipe. Accordingly, another aspect of the present invention is to equip such valve ends that are exposed to the inside of the base pipe with a device to hold back the slurry used to kill the well so that the well could later be brought back on line without internal component blockage or damage from the slurry used to kill the well.

The proposed assembly technique for these screens was to mimic the assembly of the Baker Oil Tools Equalizer® screen. What was proposed was a base pipe opening offset from the cylindrical screen section. The base pipe would not be perforated under the cylindrical screen section but rather there would be an adjacent housing over the base pipe and to one side of the cylindrical screen section with an axial passage from the annular space under the cylindrical screen section to the housing. Before assembling the housing over the hole that would accept the valve that would let liquids pass but keep gases out, the valve would be screwed into the threaded hole made to accept it and then the housing would be slipped over it and sealed to the base pipe leaving open an axial passage or passages into the housing so that filtered liquids could go through the screen then through the valve and into the base pipe to be produced at the surface. Another aspect of the invention involves an assembly where the valve is installed in the base pipe and the side housing is eliminated in favor of simply mounting the valve so that its extension through the outer surface of the base pipe is small enough or flush so that the cylindrical screen section can be placed right over the valve and secured to the base pipe to simplify the time and cost of assembly of a screen section. These and other advantages of the present invention will be more readily appreciated by those skilled in the art from a review of the description of the preferred embodiment and the associated drawings while recognizing that the claims represent the full scope of the invention.

SUMMARY OF THE INVENTION

In one aspect of the invention a valve that operates in association with a downhole screen is threaded into the wall of a base pipe after being inserted through a saddle. When the valve body is threaded in, the engagement into the wall threads in the base pipe acts as a sealing force on a ring seal between the saddle and the base pipe and between the valve body and the saddle. The valve itself can be outfitted with a cover with openings that can be integral or removable and disposed at the end of the valve that is innermost to the base pipe. Preferably a series of elongated slots are used that can catch slurry if the well is to be killed while allowing subsequent production to drive the accumulated solids from well killing back into the base pipe. Another feature places the valve in a base pipe opening under a cylindrical screen section to reduce assembly time and cost of constructing an adjacent housing to one side of the cylindrical screen section to accommodate the valve.

DETAILED DESCRIPTION OF THE PREFERRED EMBODIMENT

Figure 1:
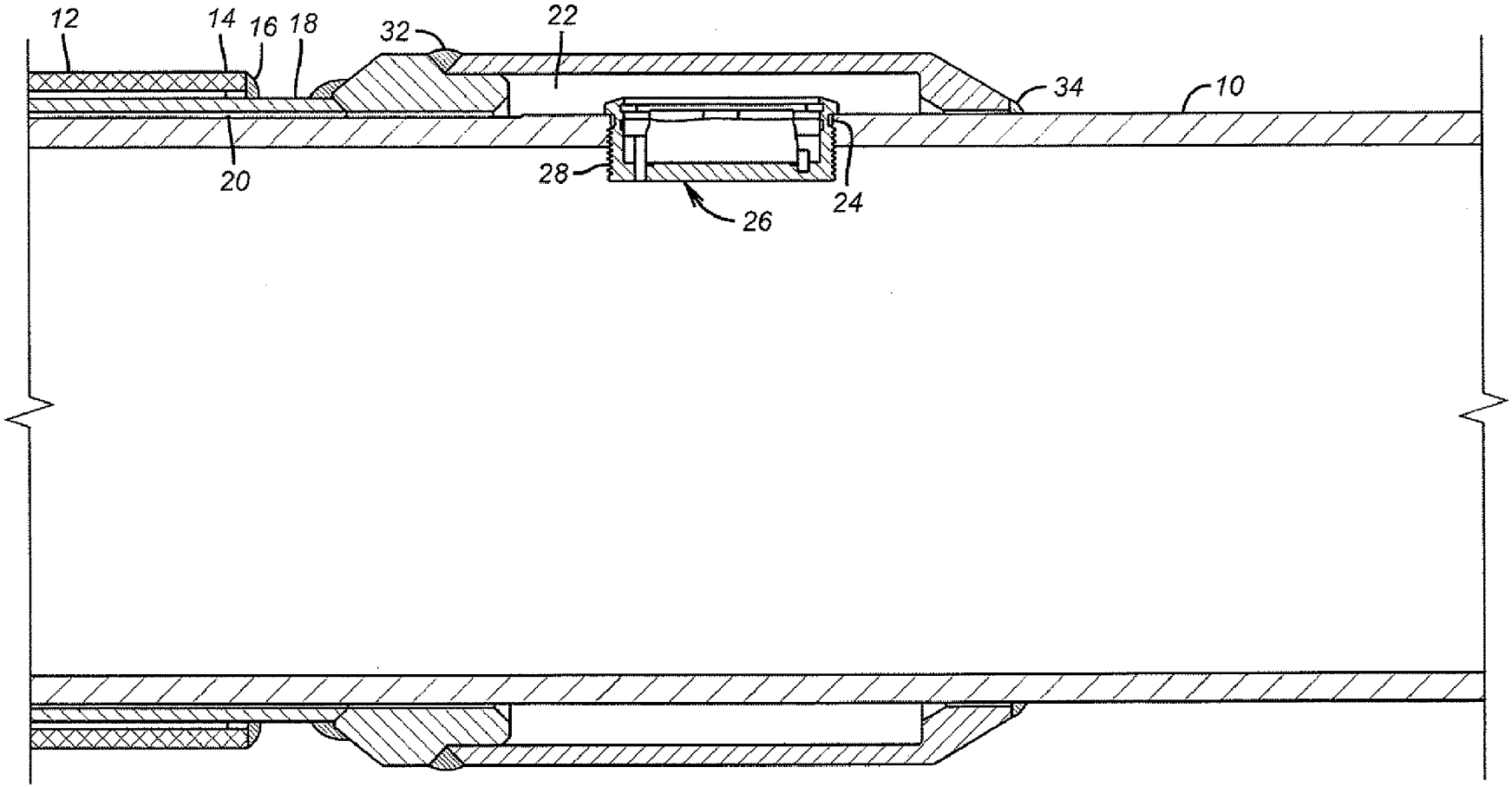
(PRIOR ART) FIG. 1
FIG. 1 is a section view of a valve mounted in the base pipe wall under a housing separate from an adjacent cylindrical screen section.

FIG. 1 illustrates a base pipe 10 with a cylindrically shaped screen 12 mounted over it and sealed at both ends although only one end is shown. At end 14 there is a continuous weld 16 to a ring 18 which includes a plurality of standoffs to define axially extending passages 20 that lead to annularly shaped chamber 22. One or more openings 24 are first placed in the base pipe 10 wall and threaded to accept valve assembly 26 at its thread 28. After the screen 12 is attached, as described, and the openings 24 created and tapped, the valve assembly 26 is screwed in and the sleeve 30 is put into position and continuously welded at top 32 and bottom 34. The valve illustrated in FIG. 1 has the capability to detect gas flow apart from liquid flow and close, or restrict, when gas flow is detected. Its internal workings are not a part of the present invention. This assembly technique is time consuming and expensive.

Figure 2:
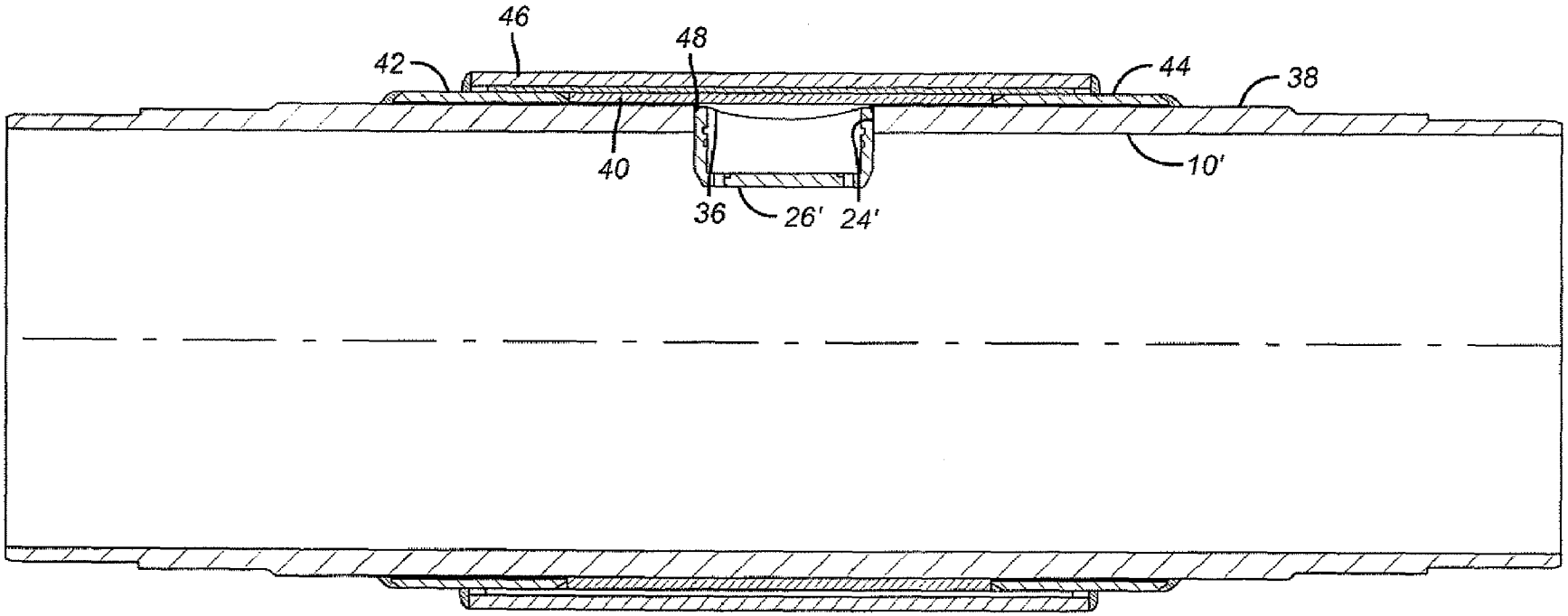
FIG. 2 is a section view of a screen valve located through the base pipe wall and under the cylindrical screen section.

FIG. 2 shows a way to assemble the components more quickly and economically and still get the desired performance. It shows the valve assembly 26' mounted deeper within opening 24' in the base pipe 10'. There are options for the actual position of the valve inlet top 36 with respect to the outer wall 38 of the base pipe 10'. The top 36 can be within the outer wall 38 or flush with it or even extending out but not so far out so as to impede the ability to slide on cylindrical screen cartridge 40 over the assembly 26' and secure it to either end to end rings 42 and 44. The cartridge 40 can be secured by welding, as shown, or by other equivalent techniques. Optionally, an outer shroud 46 can be attached to the cartridge 40 in a variety of ways with welding illustrated in FIG. 2. A comparison of FIGS. 1 and 2 will allow those skilled in the art to appreciate the greater simplicity of the FIG. 2 design as many fabrication steps are eliminated and what results is comparable in performance. The small clearance or interference fit between the inside of the cartridge 40 and the top 36 also prevents the assembly 26' from unthreading as its ability to travel up is constrained or eliminated. As a result, the present invention, illustrated in the context of a downhole screen, offers an assembly of a valve operating to regulate flow through another downhole tool wherein the downhole tool envelops the valve. While this aspect of the present invention is illustrated in the context of a screen with a valve that discriminates between gas and liquid flow, those skilled in the art will appreciate that a variety of valve types can be used or even other types of equipment such as sensors, transmitters or processors to name a few. The surrounding equipment need not be limited to a screen and the use of an outer shroud 46, if a screen is used, is considered optional for the protection of the screen 40 on its way to the desired wellbore location. The preferred manor of mounting the valve assembly 26' to the base pipe 10' will be described below. Those skilled in the art will appreciate that the aspect of the invention illustrated in FIG. 2 can be used with any mode of attachment for the valve assembly 26' including the preferred mode that will be described below. It happens that in FIG. 2 the top 36 is shown flush with outer wall 38 and secured with a weld 48.

Figure 3:
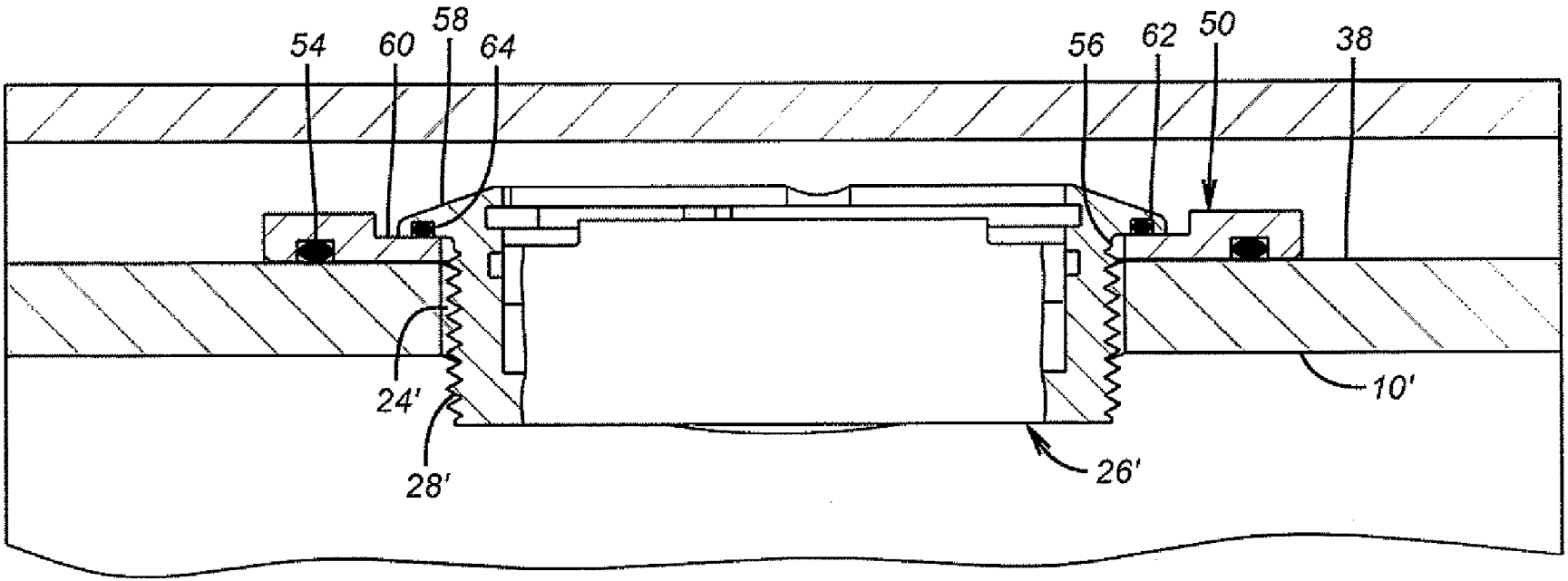
FIG. 3 is a section view of a mounting detail for a valve through a base pipe and a saddle used in mounting it.

FIG. 3 illustrates a way to assemble valve assembly 26' into the base pipe 10'. Opening 24' in the base pipe 10' is bored and threaded. There are threads 28' on the valve assembly 26'. A saddle 50, better seen in FIG. 3, has a recess 52 that surrounds the opening 24' when placed against the outer wall 38. Preferably a continuous o-ring seal 54 is fitted into groove 52 before the saddle 50 is placed on the base pipe 10' with its opening 56 aligned with opening 24' in the base pipe 10'. The valve assembly 26' further has a top flange 58 designed to rest on ledge 60 of the saddle 50. A groove 62 surrounds thread 28' and is designed to hold an o-ring seal 64 against ledge 60 when the valve assembly 26' is screwed down. Seal rings 54 and 64 seal off potential leak paths if fluids get past the threads 28'. This method of assembly eliminates any need to weld near valve assembly 26' which could have its internal components ruined from the heat generated in the welding process. In this manner, the valve assembly 26' is secured without the heat from welding buy but features backup seals to deal with the issue of thread leaks that can develop past thread 28'. In this aspect of the invention a mounting technique that backs up a threaded connection without having to weld is deployed preferably in a downhole screen with valve combination application for downhole use although connection techniques through the wall of tubulars or vessels is envisioned within the scope of the invention beyond a downhole screen application that incorporates a valve that discriminates between gas and liquid flow, as illustrated partially in FIG. 3.

Figure 4:
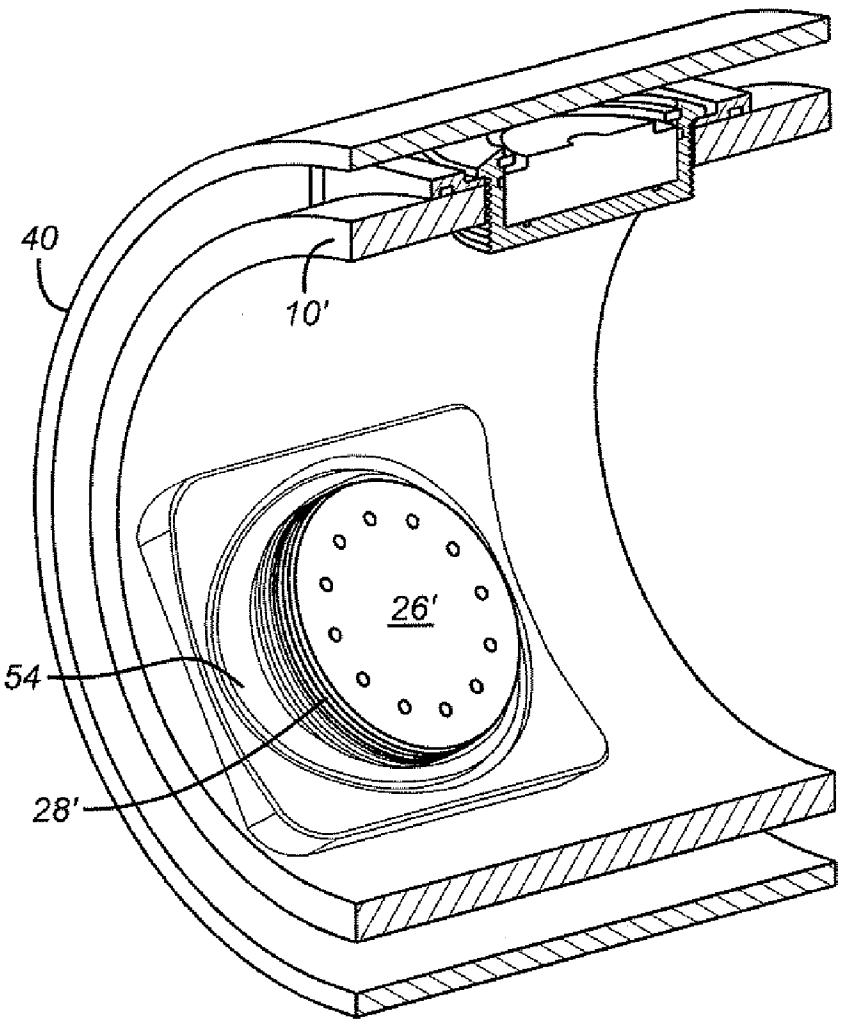
FIG. 4 is a see though view through the base pipe wall showing the seal on the underside of the saddle going around the base pipe opening for the valve.

FIG. 4 is another view of FIG. 3 to illustrate the extent of o-ring seal 54 and how it encircles thread 28' on the valve assembly 26'. Also schematically illustrated is a screen 40 that can span over the valve assembly 26' in the manner illustrated in FIG. 2. It is also within the scope of the invention to use the assembly of FIG. 1 but to secure the valve assembly 26 shown there in the manner illustrated in FIG. 3.

Figure 5:
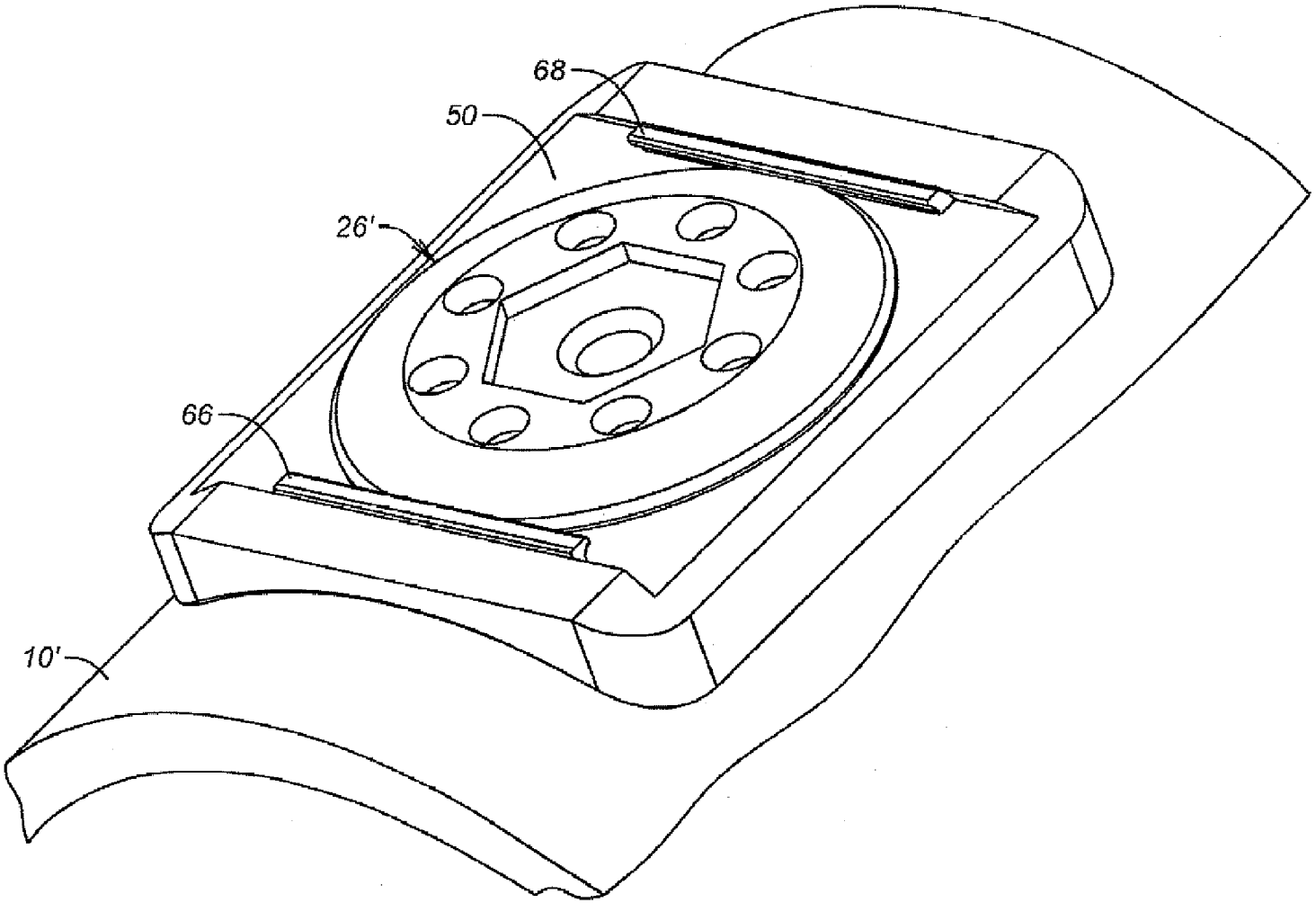
FIG. 5 is a perspective view of the valve through a saddle and the use of wedges to keep the valve from becoming unthreaded.
Figure 6:
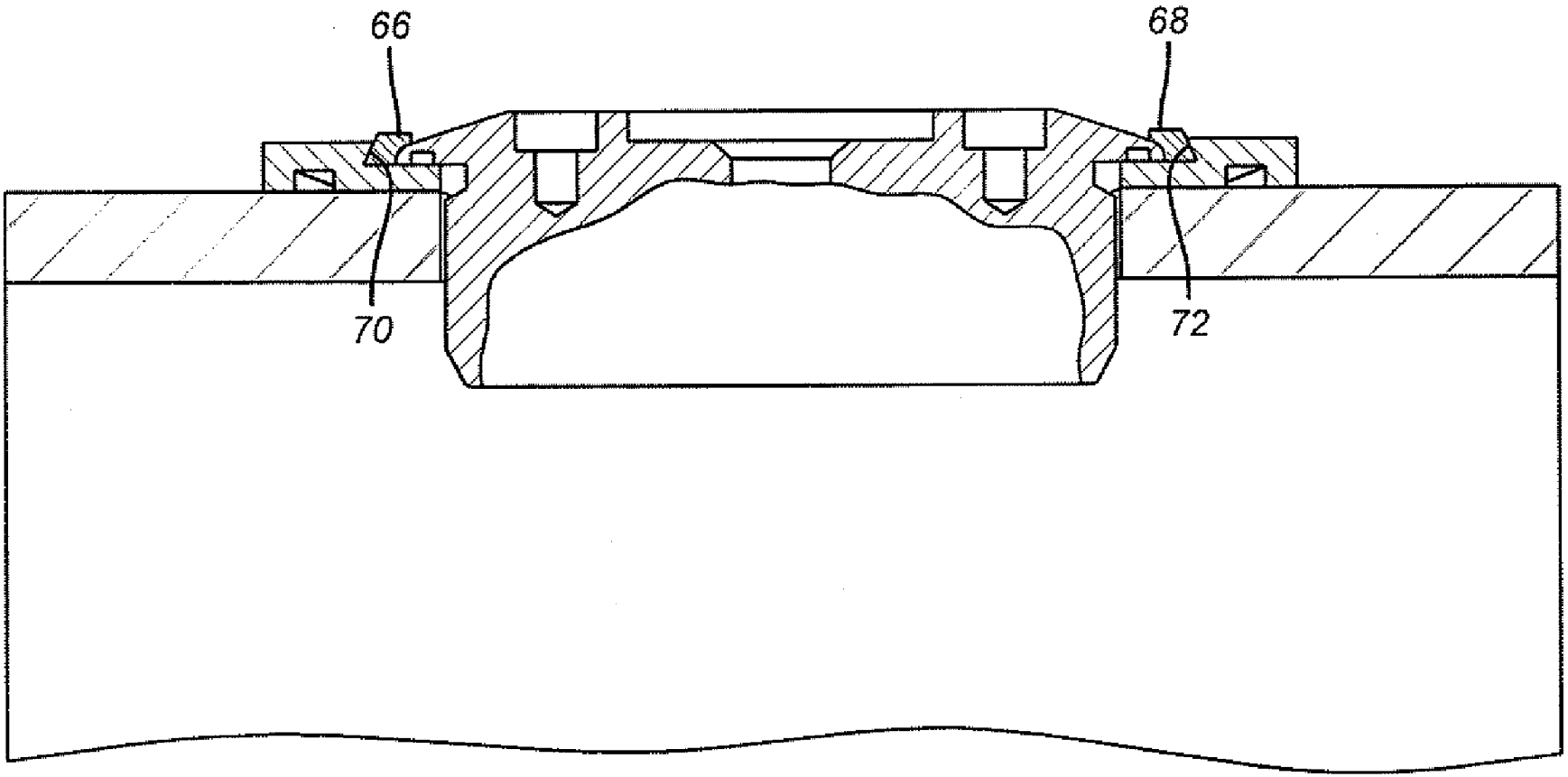
FIG. 6 is a section through the view of FIG. 5 showing the wedges that keep the valve from unthreading.

FIG. 5 shows the saddle 50 with the valve assembly 26' screwed in and holding the saddle 50 to the base pipe 10', as previously described, but with the added feature of wedges 66 and 68 used to hold the valve assembly 26' to the saddle 50 against unthreading at thread 28'. FIG. 6 shows wedges 66 and 68 in section and how they are retained by reverse shoulders 70 and 72 respectively.

Figure 7:
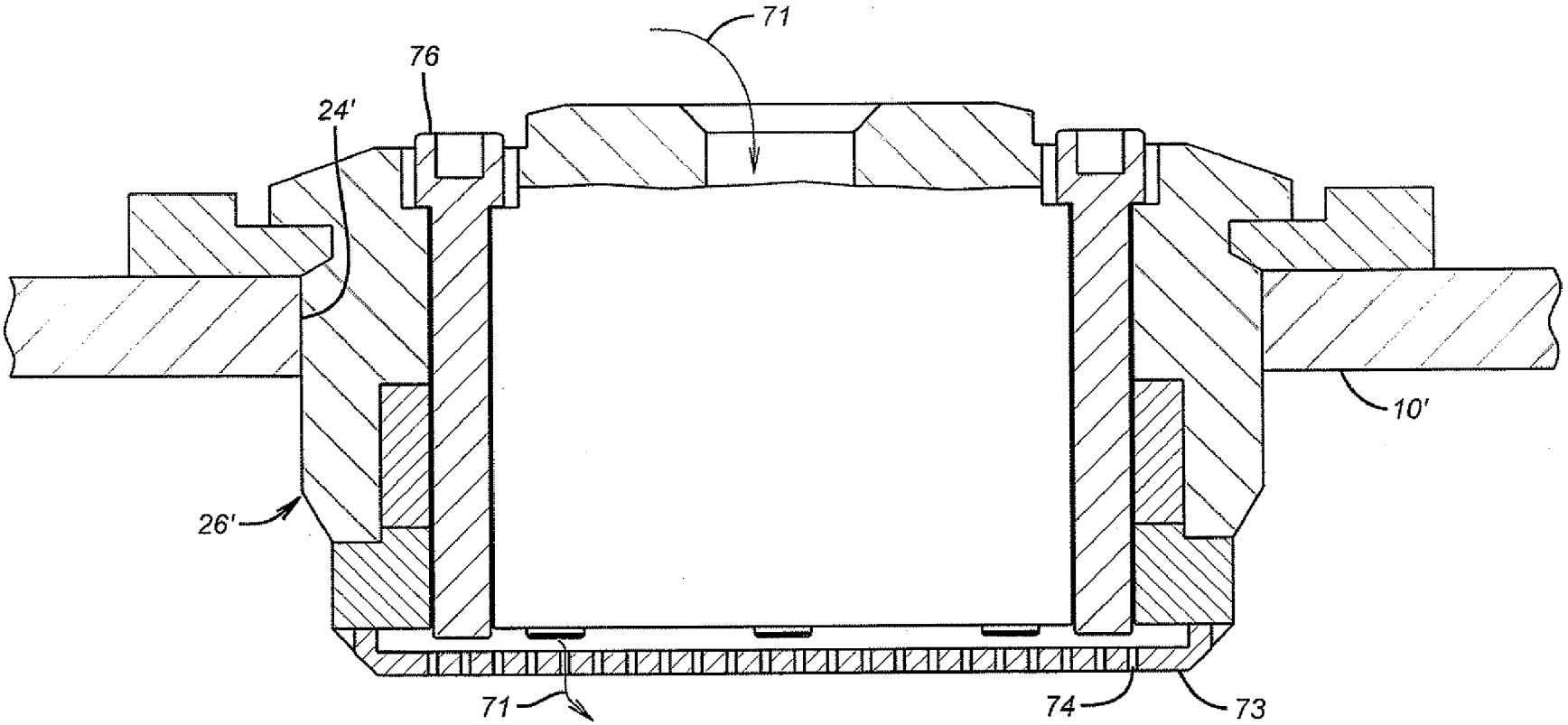
FIG. 7 is a section view showing an integral screen for catching material used to kill the well with reverse flow through the valve.
Figure 9:
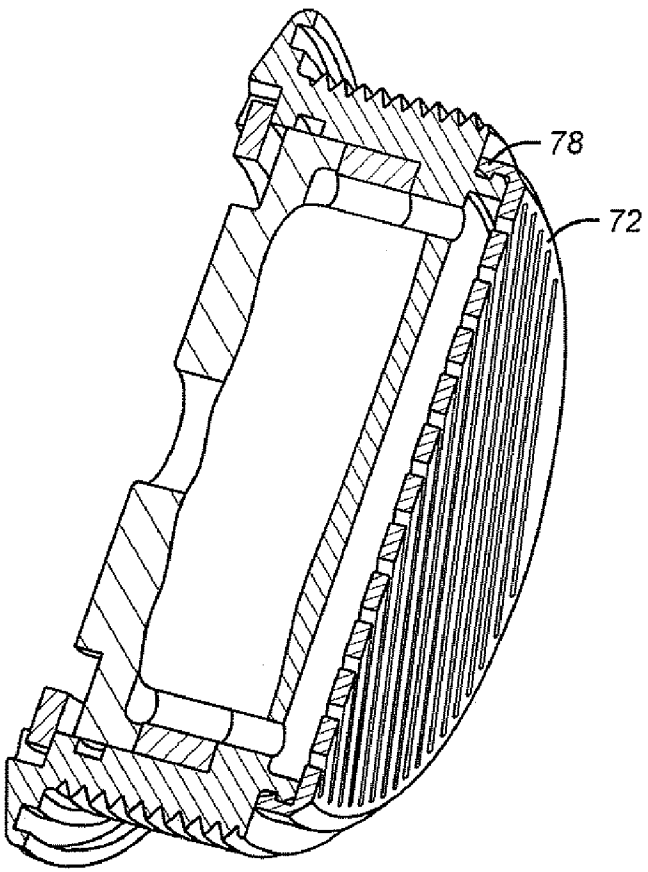
FIG. 9 is an alternative embodiment to the section of FIG. 7 showing a snap on and removable well killing screen that can be put on the end of the valve that is in the base pipe.
Figure 8:
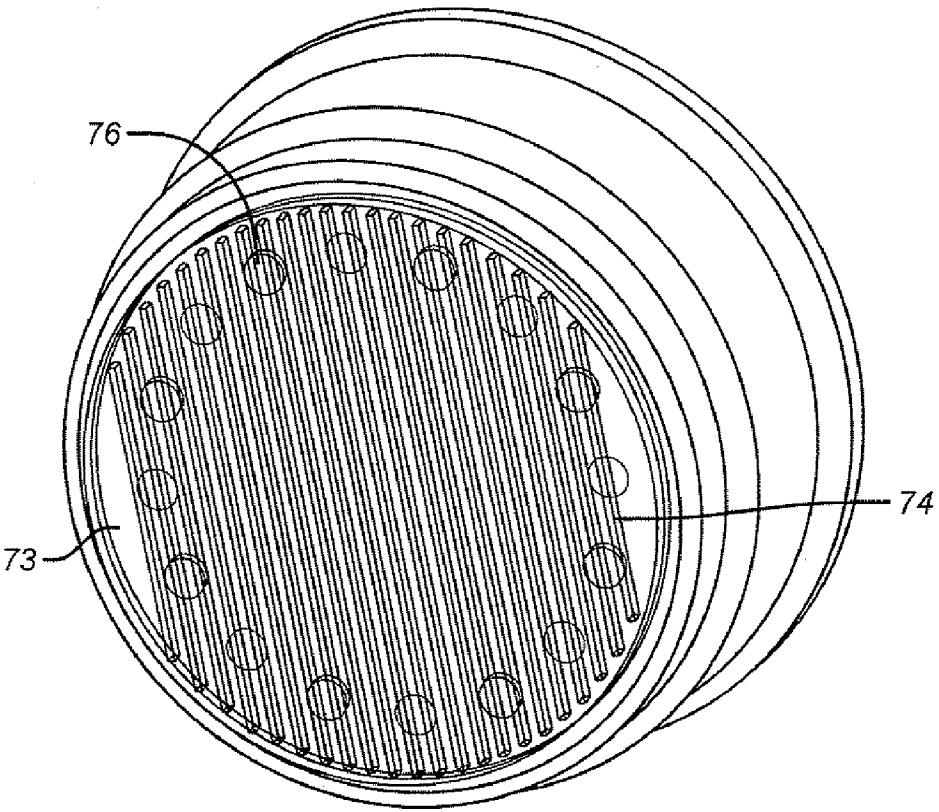
FIG. 8 is a perspective view of the view in FIG. 7 showing some valve passages behind the well killing screen.

FIG. 7 illustrates a valve assembly 26' through the wall of the base pipe 10'. The normal flow is through the screen that is not shown and in the direction of arrows 71. Shown at the valve exit is a cover 73 that includes a series of parallel slots 74 that are also seen in FIG. 8. For orientation between the views in these two FIGS. the bolts 76 are illustrated in both views. The plate 72 can be integral to the valve assembly 26' or it can be removably mounted, such as with a snap edge fit 78 illustrated in FIG. 9. The reason the plate 72 is handy is when there is a need to kill the well that necessarily has a string in it that is at least in part sections of screen. The way the well needs to be killed is from the surface by obstructing the openings 24' in which the valve assemblies 26' reside. The problem with past designs of valve assemblies such as 26' is that they lacked any feature to prevent slurry material used to kill the well from entering the inside of the valve assembly 26' and gumming up the moving parts. The slots 74 are sized to prevent pumped slurry into the base pipe from the surface from entering the valve assembly 26'. Although slots are shown any configuration that will stop the pumped slurry from entering the inside of valve assembly 26' is a suitable alternative. After the well is in control, production can resume by simply letting the well come in and the flow in the direction of arrow 71 will simply push away and up to the surface the accumulated pumped down slurry that was earlier delivered in killing the well. The slots also prevent wellbore debris from entering the valve from within the liner, which may cause the valve to malfunction, during the life of the valve.

The above description is illustrative of the preferred embodiment and many modifications may be made by those skilled in the art without departing from the invention whose scope is to be determined from the literal and equivalent scope of the claims below.

We claim:

1. A downhole screen for placement adjacent a producing formation, comprising:

a base pipe sufficiently strong to conduct pressurized fluid into or from the formation with at least one opening, said base pipe having an outer surface;

a tubular screen surrounding said base pipe and slidably positionable over said outer surface to be mounted to said outer surface of said base pipe in a manner where said screen spans over said opening;

a valve in said opening having a valve member operable while allowing flow in opposed directions.

2. The screen of claim 1, wherein:

said valve further comprises at least one seal for a leak path between said valve and said opening.

3. The screen of claim 2, wherein:

said valve further comprises a filter disposed on said valve at a location within said base pipe to allow particles delivered into the base pipe to be retained by said filter to selectively obstruct it.

4. The screen of claim 2, wherein:

said opening in said base pipe is threaded and said valve comprises a mating thread for securing said valve to said thread.

5. The screen of claim 4, further comprising:

a saddle with a hole therethrough to be placed on the base pipe before said thread in said base pipe is engaged, said valve, when threaded, retaining said saddle to said base pipe.

6. The screen of claim 5, wherein:

said valve comprises a flange with said at least one seal comprising a first seal to overlap said saddle to retain and seal against said saddle.

7. The screen of claim 6, wherein:

said at least one seal further comprises a second seal to surround the hole in the base pipe for sealing between said saddle and said base pipe and around said hole.

8. The screen of claim 5, wherein:

said at least one seal further comprises a first seal to surround the hole in the base pipe for sealing between said saddle and said base pipe and around said hole.

9. The screen of claim 1, wherein:

said valve further comprises a filter disposed on said valve at a location within said base pipe to allow particles delivered into the base pipe to be retained by said filter to selectively obstruct it.

10. The screen of claim 9, wherein:

said filter is removably mounted.

11. The screen of claim 1, wherein:

said valve selectively allows passage of liquid and closes, or restricts, if gas is present.

12. A downhole screen for placement adjacent a producing formation, comprising:

a base pipe sufficiently strong to conduct pressurized fluid into or from the formation with at least one opening, said base pipe having an outer surface;

a tubular screen surrounding said base pipe and slidably positionable over said outer surface to be mounted to said outer surface of said base pipe in a manner where said screen spans over said opening;

a valve in said opening;

said valve further comprises at least one seal for a leak path between said valve and said opening.

13. The screen of claim 12, wherein:

said opening in said base pipe is threaded and said valve comprises a mating thread for securing said valve to said thread.

14. The screen of claim 13, further comprising:

a saddle with a hole therethrough to be placed on the base pipe before said thread in said base pipe is engaged, said valve, when threaded, retaining said saddle to said base pipe.

15. The screen of claim 14, wherein:

said valve comprises a flange with said at least one seal comprising a first seal to overlap said saddle to retain and seal against said saddle.

16. The screen of claim 14, wherein:

said at least one seal further comprises a first seal to surround the hole in the base pipe for sealing between said saddle and said base pipe and around said hole.

17. The screen of claim 16, wherein:

said saddle comprises a second seal to surround the hole in the base pipe for sealing between said saddle and said base pipe and around said hole.

18. The screen of claim 12, wherein:

said valve selectively allows passage of liquid and closes, or restricts, if gas is present.

19. A downhole screen for placement adjacent a producing formation, comprising:

a base pipe sufficiently strong to conduct pressurized fluid into or from the formation with at least one opening, said base pipe having an outer surface;

a tubular screen surrounding said base pipe and slidably positionable over said outer surface to be mounted to said outer surface of said base pipe in a manner where said screen spans over said opening;

a valve in said opening;

said valve further comprises a filter disposed on said valve at a location within said base pipe to allow particles delivered into the base pipe to be retained by said filter to selectively obstruct it.

20. The screen of claim 19, wherein:

said filter is removably mounted.

21. The screen of claim 19, wherein:

said filter comprises a plurality of elongated openings.

22. The screen of claim 19, wherein:

said valve selectively allows passage of liquid and closes, or restricts, if gas is present.

* * * * *